US010351336B2

(12) United States Patent
Cavallari et al.

(10) Patent No.: US 10,351,336 B2
(45) Date of Patent: Jul. 16, 2019

(54) CONTAINER HAVING A MOVABLE WALL

(71) Applicant: Philip Morris Products S.A., Neuchatel (CH)

(72) Inventors: Stefano Cavallari, Bologna (IT); Sergey Krasiev, Le Mont sur Lausanne (CH)

(73) Assignee: Philip Morris Products S.A., Neuchatel (CH)

( * ) Notice: Subject to any disclaimer, the term of this patent is extended or adjusted under 35 U.S.C. 154(b) by 312 days.

(21) Appl. No.: 15/321,830

(22) PCT Filed: Jun. 26, 2015

(86) PCT No.: PCT/EP2015/064617
§ 371 (c)(1),
(2) Date: Dec. 23, 2016

(87) PCT Pub. No.: WO2015/197864
PCT Pub. Date: Dec. 30, 2015

(65) Prior Publication Data

US 2017/0137209 A1 May 18, 2017

(30) Foreign Application Priority Data

Jun. 27, 2014 (EP) ..... 14174787

(51) Int. Cl.
*B65D 85/10* (2006.01)
*A24F 15/12* (2006.01)
(Continued)

(52) U.S. Cl.
CPC ..... *B65D 85/1045* (2013.01); *A24F 15/12* (2013.01); *B31B 50/60* (2017.08);
(Continued)

(58) Field of Classification Search
CPC ..... B65D 5/54; B65D 5/422; B65D 5/4266; B65D 5/6602; B65D 85/1045;
(Continued)

(56) References Cited

U.S. PATENT DOCUMENTS 2,074,451 A * 3/1937 Berberian ..... B65D 85/1063 206/256
2,410,987 A * 11/1946 Mevi ..... A24F 15/18 206/236
(Continued)

FOREIGN PATENT DOCUMENTS

CN 2226043 Y 5/1996
CN 1202447 A 12/1998
(Continued)

OTHER PUBLICATIONS

International Search Report dated Sep. 24, 2015 in PCT/EP2015/064617 filed Jun. 26, 2015.
(Continued)

*Primary Examiner* — Luan K Bui
(74) *Attorney, Agent, or Firm* — Oblon, McClelland, Maier & Neustadt, L.L.P.

(57) ABSTRACT

A container for consumer goods is provided, including a box including a bottom wall, two side walls, a back box wall, a front wall, a movable container back wall, and a lid. The movable container back wall depends along a first fold line from the box, is movable about the first fold line between an open position and a closed position, and at least partially overlies the back box wall when in the closed position. The lid depends along a hinge line from the movable container back wall and is movable between the open and the closed positions. A first and a second compartment each configured to receive the consumer goods are located in the box, the first compartment is accessible when the lid is in the open position, and the second compartment is accessible when both the lid and the movable container back wall are in respective open positions.

12 Claims, 11 Drawing Sheets

(51) Int. Cl.

| | |
|---|---|
| ***B65D 5/42*** | (2006.01) |
| ***B65D 5/54*** | (2006.01) |
| ***B65D 5/66*** | (2006.01) |
| ***B31B 50/60*** | (2017.01) |
| *B31B 50/26* | (2017.01) |
| *B31B 50/81* | (2017.01) |
| *B31B 105/00* | (2017.01) |
| *B31B 120/20* | (2017.01) |

(52) U.S. Cl.
CPC ..... *B65D 5/4266* (2013.01); *B65D 5/54* (2013.01); *B65D 5/6602* (2013.01); *B65D 85/1081* (2013.01); *B31B 50/26* (2017.08); *B31B 50/81* (2017.08); *B31B 2105/00* (2017.08); *B31B 2120/20* (2017.08); *B31B 2241/003* (2013.01)

(58) Field of Classification Search
CPC ..... B65D 85/1081; A24F 15/12; B31B 50/26; B31B 50/81; B31B 50/60; B31B 2105/00; B31B 2120/20
USPC ..... 206/242, 256, 265, 268, 271, 273; 220/505, 810, 835; 493/162
See application file for complete search history.

(56) References Cited

U.S. PATENT DOCUMENTS

| | | | | |
|---|---|---|---|---|
| 2,958,417 | A * | 11/1960 | Adams | A24F 15/18 206/246 |
| 3,028,950 | A * | 4/1962 | Content | A24F 15/18 206/246 |
| 3,090,482 | A * | 5/1963 | Sandacz | B65D 85/1045 206/246 |
| 4,989,728 | A * | 2/1991 | Neyret | B65D 85/109 206/248 |
| 5,826,785 | A | 10/1998 | Belvederi et al. | |
| 8,322,524 | B2 * | 12/2012 | Mazur | B65D 85/109 206/268 |
| 8,967,382 | B2 * | 3/2015 | Liu | A24F 15/18 206/236 |
| 2008/0029411 | A1 * | 2/2008 | Polloni | B65D 5/422 206/268 |

FOREIGN PATENT DOCUMENTS

| | | | |
|---|---|---|---|
| CN | 101005991 | A | 7/2007 |
| EP | 0 350 739 | A1 | 1/1990 |
| EP | 1 763 473 | | 3/2007 |
| RU | 2518210 | C2 | 6/2014 |
| WO | WO 2005/105588 | A1 | 11/2005 |
| WO | WO 2013/102841 | A1 | 7/2013 |

OTHER PUBLICATIONS

Written Opinion dated Sep. 24, 2015 in PCT/EP2015/064617 filed Jun. 26, 2015.

Combine Russian Federation Office Action and Search Report dated Sep. 18, 2018 in Patent Application No. 2017102482/12(004380) (with English translation and English translation of categories of cited documents), citing document AO therein, 19 pages.

Combined Office Action and Search Report dated Dec. 4, 2017 in Chinese Patent Application No. 201580031505.7 (with English language translation) citing references AO-AQ therein, 13 pages.

* cited by examiner

CONTAINER HAVING A MOVABLE WALL

The present invention relates to a container for receiving consumer goods and comprising a movable wall. The present invention also relates to a method of forming a container for receiving consumer goods and comprising a movable wall. Containers in accordance with the present invention find particular application as containers for elongate smoking articles, such as cigarettes.

It is known to package elongate smoking articles and other consumer goods in containers formed from folded laminar blanks. Elongate smoking articles, such as cigarettes and cigars, are commonly sold in hinge-lid packs having a box for housing the smoking articles and a lid connected to the box about a hinge line extending across the back wall of the container. Such packs are typically constructed from laminar cardboard blanks. In use, the lid is pivoted about the hinge line to open the pack and so gain access to the bundle of smoking articles held in the box.

It would be desirable to provide a novel container for consumer goods that provides additional functionality when compared with conventional containers. It would be particularly desirable to provide such a container that can be readily produced without significant modification of existing manufacturing processes or packaging equipment.

According to a first aspect the present invention provides a container for consumer goods, the container comprising a box comprising a bottom wall, two side walls, a back wall and a front wall. The container further comprises a movable container back wall depending along a first fold line from the box, wherein the movable container back wall is movable about the first fold line between an open position and a closed position, and wherein the movable container back wall at least partially overlies the box back wall when the movable container back wall is in the closed position. A lid depends along a hinge line from the movable container back wall, the lid being movable between an open position and a closed position. A first compartment for receiving consumer goods is located in the box, wherein the first compartment is accessible when the lid is in the open position, and a second compartment for receiving consumer goods is also located in the box, wherein the second compartment is accessible when both the lid and the movable container back wall are in their respective open positions.

The terms "side", "top", "bottom", "front", "back" and other terms used to describe relative positions of the components of containers according to the invention refer to the container in an upright position with the lid at the top and the box bottom wall at the bottom. When describing containers according to the present invention, these terms are used irrespective of the orientation of the container being described. The hinge line that allows opening of the lid of the container by a pivotal movement is located at the "back" of the container. Conversely, the "front" of the container refers to the facet of the container opposite of the "back" of the container.

The term "panel" is used herein to refer to a portion of the container formed from a single, continuous portion of material. A panel may depend along one or more fold lines from one or more other panels. The term "flap" refers to a panel that depends along only one fold line from only one other panel.

The term "wall" refers more generally to a facet of the container, and a wall may be formed from a single panel or flap, or a wall may be formed from two or more abutting or overlapping panels or flaps.

The term "hinge line" refers to a line about which two elements may be pivoted relative to each other. A hinge line may be, for example, a fold line, a perforation line or a score line in a wall or panel of the container. Alternatively, the two elements may be formed separately and hinged together by a third element. For example, two panels that abut each other along a cut line may be joined by a label or a sticker extending between the two panels across the cut line, wherein the label or the sticker permits relative movement between the two panels along the cut line. In this case, the label or the sticker forms a hinge and the cut line forms the hinge line.

By providing first and second compartments for receiving consumer goods, containers according to the present invention can be constructed so that their external appearance resembles that of a conventional container while still remaining suitable for accommodating consumer goods that may be significantly smaller than the container. For example, the container can be constructed so that it resembles a conventional hinge-lid pack for elongate smoking articles while receiving consumer goods within the first and second compartments that are significantly smaller than conventional filter cigarettes.

Furthermore, containers according to the present invention can maintain the external appearance and dimensions of a more conventional container, therefore eliminating the need to modify downstream processes, such as wrapping and packing of the containers and displaying the containers at the point of sale.

Additionally, providing first and second compartments may advantageously reduce unwanted movement of remaining consumer goods when one or a few of the consumer goods have been removed, compared to a traditional container having a single large compartment for receiving the consumer goods.

Advantageously, containers according to the present invention can also provide added functionality when compared to conventional containers as a result of the movable container back wall. For example, the movable container back wall may be moved from the closed position to the open position to reveal a message, indicia or other information to the consumer.

To prevent accidental or inadvertent opening of the movable container back wall, the movable container back wall is preferably movable from the closed position to the open position only when the lid is in the open position. For example, in some embodiments the lid comprises a front wall that at least partially overlaps a portion of the box front wall when the lid is in the closed position. In these embodiments, the overlap between the lid front wall and the box front wall retains the movable container back wall in the closed position.

In any of the embodiments described above, the container may further comprise an aperture in the box back wall, wherein the movable container back wall at least partially covers the aperture when the movable container back wall is in the closed position, and wherein the aperture permits access to the second compartment when the movable container back wall is moved from the closed position to the open position. In some embodiments, the second compartment is connected to the movable container back wall so that the second compartment moves through the aperture in the box back wall when the movable container back wall moves between the open and closed positions.

The term "connected" refers to two or more portions of the container that may be formed integrally as a single piece, or two or more portions that may be formed separately and attached to each other. For example, two or more separate portions may be secured to each other using an adhesive to directly secure the two or more portions together, or using a further element, such as a label or a sticker, that is secured to and extends between the two or more portions.

The container may further comprise one or more frangible portions connecting a part of the movable container back wall to the box, preferably at an edge of the aperture. In these embodiments, the frangible portions retain the movable container back wall in the closed position until the frangible portions are broken upon the user first moving the movable container back wall into the open position. Therefore, the frangible portions can prevent premature or accidental opening of the movable container back wall until the user wishes to access the second compartment. For example, the user may wish to remove one or more consumer goods contained within the first compartment and access the second compartment only once no consumer goods remain within the first compartment. In this case, the user can open the lid to gain access to the first compartment while the frangible portions prevent accidental opening of the movable container back wall, even when the lid is in the open position.

The frangible portion may comprise a line of weakening, such as a perforation line comprising a series of perforations and a segment of uncut material between each pair of consecutive perforations. In this case, the perforation line preferably defines at least a portion of the edge of the aperture. The length of each perforation is preferably significantly larger than the length of the adjacent segments of uncut material so that the perforation line comprises a relatively small number of uncut material segments. Minimising the number of uncut material segments makes it easier for the user to open the movable container back wall for the first time. For example, the perforation line may comprise between one and ten segments of uncut material, preferably between one and five segments of uncut material.

As an alternative to the frangible portions defining an edge of the aperture, the frangible portions may connect the movable container back wall to the box at a different location on the container. For example, the container may comprise one or more frangible portions connecting the movable container back wall to the box along an edge of the container between the movable container back wall and a box side wall.

In addition to one or more frangible portions connecting a part of the movable container back wall to the box, or as an alternative, the container may comprise a low tack adhesive provided on at least one of the movable container back wall and the box back wall, wherein the low tack adhesive releasably retains the movable portion in the closed position.

Additionally, or alternatively, the container may comprise at least one tear strip extending between at least a portion of the movable container back wall and at least a portion of the box, wherein a user must remove the at least one tear strip from the container before the movable container back wall can be moved to the open position for the first time. As well as preventing accidental and premature opening of the movable container back wall, the at least one tear strip provides a tamper evidence so that the user can be certain that the movable container back wall has not been opened previously.

Additionally, or alternatively, the container may comprise at least one of a magnetic closure or a hook and loop closure between the movable container back wall and the box to releasably retain the movable container back wall in the closed position.

Additionally, or alternatively, the container may comprise at least one of one or more frangible portions, a low tack adhesive, at least one tear strip, a magnetic closure, and a hook and loop closure between the lid and the box to prevent accidental or premature opening of the lid.

In any of the embodiments described above, the second compartment may be sealed, preferably substantially hermetically sealed, until the seal is broken or opened by the user. The seal may extend between the second compartment and part of the box so that the seal is automatically broken or opened when the user moves the movable container back wall into the open position for the first time. Preferably, the seal is resealable so that the seal is automatically opened and closed as the movable container back wall is opened and closed. For example, the seal may comprise a label or flap that extends between the box and the second compartment and covers the second compartment when the movable container back wall is in the closed position. Preferably, the label or flap is provided with a low tack adhesive on a side facing the second compartment, wherein the low tack adhesive provides a sealing effect each time the movable container back wall is closed and the low tack adhesive comes into contact with the second compartment.

Alternatively, the seal may not be connected to the box so that the seal must be opened manually by the user after the movable container back wall has been moved into the open position.

Providing a seal on the second compartment advantageously isolates the second compartment from the environment until the user decides to access the second compartment, while at the same time allowing the user to access any consumer goods that may be contained within the first compartment. Therefore, in embodiments in which consumer goods are contained in both the first and the second compartments, freshness of the consumer goods in the second compartment can be maintained until the user has removed all of the consumer goods from the first compartment.

The term "substantially hermetically sealed" is used to mean a seal, such as a sealed compartment or one or more sealed consumer goods, wherein the oven volatiles content of the one or more consumer goods contained within the seal does not change by more than about 4 percent by weight of the consumer goods during a 2 week period in which the seal remains intact or closed. Preferably, the oven volatiles content of the one or more consumer goods does not change by more than about 2 percent by weight of the one or more consumer goods during the 2 week period. For example, a bundle of smoking articles may comprise an oven volatiles content of about 13 percent by weight of the smoking articles at the time of manufacture. Therefore, in embodiments in which such smoking articles are substantially hermetically sealed within a compartment, the oven volatiles content of the smoking articles will be between about 9 percent and about 17 percent, preferably between about 11 percent and about 15 percent 2 weeks after the smoking articles are sealed within the compartment.

Additionally, or alternatively, the second compartment may contain one or more consumer goods that are sealed, preferably substantially hermetically sealed, separately from any consumer goods container within the first compartment. For example, the second compartment may contain one or more individually sealed consumer goods, or the second compartment may contain a bundle of consumer goods that are sealed as a single bundle. The first compartment may similarly contain one or more sealed consumer goods.

In any of the embodiments described above, the container may comprise one or more consumer goods within the first compartment and the second compartment. Preferably the container comprises one or more consumer goods in both the first and the second compartments.

In some embodiments, the one or more consumer goods comprise a plurality of aerosol-generating articles. The term "aerosol-generating article" is used herein to mean an article comprising at least one substrate that forms an aerosol when heated. As known to those skilled in the art, an aerosol is a suspension of solid particles or liquid droplets in a gas, such as air. The aerosol may be a suspension of solid particles and liquid droplets in a gas, such as air. For example, the aerosol-generating article may be an article for use in an electrically operated smoking system. In this case, the aerosol-generating article may comprise a tobacco or other nicotine-containing substrate that generates an aerosol comprising nicotine when the substrate is heated. Alternatively, the aerosol-generating article may comprise a more conventional smoking article, such as a filter cigarette.

The present invention also extends to a method of forming the container in accordance with any of the embodiments described above. Therefore, according to a second aspect, the present invention provides a method of forming a container for consumer goods, the method comprising folding a first laminar blank to form a first compartment for receiving consumer goods and folding a second laminar blank to form a second compartment for receiving consumer goods. The first and second compartments are secured to a third laminar blank and the third laminar blank is folded around the first and second compartments to form a box comprising a bottom wall, two side walls and a front wall. The folded third laminar blank is secured to a fourth laminar blank and the fourth laminar blank is folded to form a movable container back wall and a lid. The movable container back wall depends along a first fold line from the box and is movable about the first fold line between an open position and a closed position. The lid depends along a hinge line from the movable container back wall and is movable between an open position and a closed position. The first compartment is accessible when the lid is in the open position, and the second compartment is accessible when both the lid and the movable container back wall are in their respective open positions.

Providing first and second compartments for receiving consumer goods allows greater flexibility with regard to the size, shape and type of consumer goods that may be stored within the container. For example, as described above, it may be possible to form a container that resembles a conventional hinge-lid container in terms of external appearance, while the first and second compartments are adapted to receive consumer goods that are smaller than consumer goods typically stored within a conventional hinge-lid container.

Furthermore, using multiple laminar blanks to form a container having first and second compartments allows relatively simple production processes to be used despite the relative complexity of the completed container.

Preferably, the movable container back wall is movable from the closed position to the open position only when the lid portion is in the open position. As described above with respect to the container, preventing movement of the movable container back wall when the lid is in the closed position can prevent accidental or inadvertent opening of the movable container back wall. In some embodiments the at least one laminar blank is folded so that the lid comprises a front wall that at least partially overlaps a portion of the box front wall when the lid is in the closed position. In this case, the overlap between the lid front wall and the box front wall retains the movable container back wall in the closed position.

In some embodiments, the step of folding the third laminar blank to form the box comprises folding the third laminar blank to form a box back wall, wherein the movable container back wall overlies the box back wall when the movable container back wall is in the closed position. Advantageously, forming a box back wall can facilitate maintaining the rigidity of the container when the movable container back wall is in the open position.

Preferably, the third laminar blank comprises a first side, a second side and a line of weakening, wherein the step of securing the first and second compartments to the third laminar blank comprises securing a back wall of each of the first and second compartments to the first side of the third laminar blank. In this case, the step of folding the third laminar blank comprises folding the third laminar blank around the first and second compartments to form a box back wall and a first movable back panel, the first movable back panel being delineated by the line of weakening and the first fold line. The first compartment is secured to the box back wall and the second compartment is secured to the first movable back panel. The step of folding the fourth laminar blank comprises folding the fourth laminar blank to form a second movable back panel and a lid depending from the second movable back panel. The step of securing the folded third laminar blank to the fourth laminar blank comprises securing the second movable back panel of the fourth laminar blank to the second side of the first movable back panel of the third laminar blank. Once secured, the first and second movable back panels together form the movable container back wall.

In those embodiments comprising a line of weakening in the third laminar blank, the line of weakening may comprise one or more frangible portions connecting the first movable back panel to the box back wall. In this case, the frangible portions retain the movable container back wall in the closed position, and the frangible portions are broken upon first moving the movable container back wall into the open position.

As described previously, the one or more frangible portions may comprise a line of weakening, such as a perforation line comprising a series of perforations and a segment of uncut material between each pair of consecutive perforations. The length of each perforation is preferably significantly larger than the length of the adjacent segments of uncut material so that the perforation line comprises a relatively small number of uncut material segments. Minimising the number of uncut material segments makes it easier for the user to open the movable container back wall for the first time. For example, the perforation line may comprise between one and ten segments of uncut material, preferably between one and five segments of uncut material.

In those embodiments comprising a line of weakening in the third laminar blank, the edge of the first movable back panel preferably defines an aperture in the box back wall, wherein the movable container back wall covers the aperture when the movable portion is in the closed position, and wherein the aperture permits access to the second compartment when the movable container back wall is moved from the closed position to the open position. In embodiments in which the container comprises an aperture, the second compartment preferably moves through the aperture in box back wall when the movable container back wall moves between the open and closed positions.

In any of the embodiments described above, the method may comprises a step of applying a low tack adhesive to a portion of at least one of the third and fourth laminar blanks so that the low tack adhesive retains the movable container back wall in the closed position after the third and fourth laminar blanks have been folded.

Additionally, or alternatively, the method may comprise a step of forming at least one tear strip extending between at least a portion of the movable container back wall and at least a portion of the box, wherein a user must remove the at least one tear strip from the container before the movable container back wall can be moved to the open position for the first time. As well as preventing accidental and premature opening of the movable container back wall, the at least one tear strip also provides a tamper evidence so that the user can be certain that the movable container back wall has not been opened previously.

Additionally, or alternatively, the method may comprise a step of providing at least one of a magnetic closure or a hook and loop closure between the movable container back wall and the box to releasably retain the movable container back wall in the closed position.

Additionally, or alternatively, the method may comprise a step of providing at least one of one or more frangible portions, a low tack adhesive, at least one tear strip, a magnetic closure, and a hook and loop closure between the lid and the box to prevent accidental or premature opening of the lid.

In any of the embodiments described above, the second compartment may be sealed, preferably substantially hermetically sealed, until the seal is broken or opened by the user. The seal may extend between the second compartment and part of the box so that the seal is automatically broken or opened when the user moves the movable container back wall into the open position for the first time. Preferably, the seal is resealable so that the seal is automatically opened and closed as the movable container back wall is opened and closed. For example, the seal may comprise a label or flap that extends between the box and the second compartment and covers the second compartment when the movable container back wall is in the closed position. Preferably, the label or flap is provided with a low tack adhesive on a side facing the second compartment, wherein the low tack adhesive provides a sealing effect each time the movable container back wall is closed and the low tack adhesive comes into contact with the second compartment.

Alternatively, the seal may not be connected to the box so that the seal must be opened manually by the user after the movable container back wall has been moved into the open position.

Providing a seal on the second compartment advantageously isolates the second compartment from the environment until the user decides to access the second compartment, while at the same time allowing the user to access any consumer goods that may be contained within the first compartment. Therefore, in embodiments in which consumer goods are contained in both the first and the second compartments, freshness of the consumer goods in the second compartment can be maintained until the user has removed all of the consumer goods from the first compartment.

Additionally, or alternatively, the second compartment may contain one or more consumer goods that are sealed, preferably substantially hermetically sealed, separately from any consumer goods container within the first compartment. For example, the second compartment may contain one or more individually sealed consumer goods, or the second compartment may contain a bundle of consumer goods that are sealed as a single bundle. The first compartment may similarly contain one or more sealed consumer goods.

In any of the embodiments described above, the step of folding the first and second laminar blanks may comprise folding at least one of the first and second laminar blanks around one or more consumer goods. Preferably, the step of folding the first and second laminar blanks may comprise folding both of the first and second laminar blanks around one or more consumer goods.

In some embodiments, the one or more consumer goods comprise a plurality of aerosol-generating articles. The term "aerosol-generating article" is used herein to mean an article comprising at least one substrate that forms an aerosol when heated. As known to those skilled in the art, an aerosol is a suspension of solid particles or liquid droplets in a gas, such as air.

The aerosol may be a suspension of solid particles and liquid droplets in a gas, such as air. For example, the aerosol-generating article may be an article for use in an electrically operated smoking system. In this case, the aerosol-generating article may comprise a tobacco or other nicotine-containing substrate that generates an aerosol comprising nicotine when the substrate is heated. Alternatively, the aerosol-generating article may comprise a more conventional smoking article, such as a filter cigarette.

Containers in accordance with both aspects of the present invention and in accordance with any of the embodiments described above are preferably rectangular parallelepipeds each comprising two wider walls spaced apart by two narrower walls. The two wider walls will usually be the front and back walls and the two narrower walls will usually be side walls.

The containers may be formed from any suitable materials including, but not limited to, cardboard, paperboard, plastic, metal, or combinations thereof. Preferably, the containers are formed from folded laminar cardboard blanks, wherein the cardboard preferably has a basis weight of between about 100 grams per square meter and about 350 grams per square meter.

In some embodiments, each assembled and filled container may be wrapped in an outer wrapper. The outer wrapper is preferably a transparent polymeric film of, for example, high or low density polyethylene, polypropylene, oriented polypropylene, polyvinylidene chloride, cellulose film, or combinations thereof and the outer wrapper is applied in a conventional manner. The outer wrapper may include a tear tape. In addition, the outer wrapper may be printed with images, consumer information or other data.

As described above, containers according to the invention may be in the shape of a rectangular parallelepiped and may comprise right-angled longitudinal and right-angled transverse edges. Alternatively, the containers may comprise one or more rounded longitudinal edges, rounded transverse edges, bevelled longitudinal edges or bevelled transverse edges, or combinations thereof.

Where the container comprises one or more bevelled edges, preferably the bevelled edge has a width of between about 1 mm and about 10 mm, preferably between about 2 and about 6 mm. Alternatively, the container may comprise a double bevel formed by three parallel creasing or scoring lines that are spaced such that two distinct bevels are formed on the edge of the container.

Alternatively, the container may have a non-rectangular transversal cross section, for example polygonal such as triangular or hexagonal, semi-oval or semi-circular.

As described above, containers according to the invention find particular application as packs for aerosol-generating articles such as, for example, cigarettes, cigars, cigarillos, or aerosol-generating articles for use in an electrically operated smoking system. It will be appreciated that through appropriate choices of the dimensions, at least one of the first and second compartments may be designed for different numbers of aerosol-generating articles. Alternatively, other consumer goods may be housed inside the containers.

Preferably, containers according to the invention have a width of between about 40 mm and about 100 mm, more preferably a width of between about 50 mm and about 90 mm, wherein the width is measured from one side wall to the other side wall of the container.

Preferably, containers according to the invention have a depth of between about 6 mm and about 150 mm, more preferably a depth of between about 12 mm and about 25 mm wherein the depth is measured from the front wall to the back wall of the container.

Preferably, the ratio of the height of the container to the depth of the container is in between about 1 to 1 and about 10 to 1, more preferably between about 2 to 1 and about 8 to 1, most preferably between about 3 to 1 and about 5 to 1.

Preferably, the ratio of the width of the container to the depth of the container is in between about 1 to 1 and about 10 to 1, more preferably between about 2 to 1 and about 8 to 1, most preferably between about 2 to 1 and about 3 to 1.

Where the container houses aerosol-generating articles, the aerosol-generating articles may be housed in both the first and second compartments. Alternatively, the aerosol-generating articles may be housed in only one of the compartments. In this case, the other compartment may receive waste, such as ash or butts, or other consumer goods, for example matches, lighters, extinguishing means, breath-fresheners or electronics.

The first and second compartments may have the same orientation within the container. For example, both the first and second compartments may comprise an opening that faces the top of the container. Alternatively, the first and second compartments may have different orientations. For example, the first compartment may have an opening that faces the top of the container and the second compartment may have an opening that faces a side of the container.

For ease of construction of the container, the first fold line about which the movable container back wall is movable may be a fold line between the box bottom wall and the movable container back wall. That is, the fold line may form an edge of the container where the box bottom wall meets the movable container back wall. Alternatively, the first fold line may be located elsewhere on the container. For example, the first fold line may be a fold line between one of the box side walls and the movable container back wall. Alternatively, the fold line may be located across the back of the container, so that the movable container back wall depends along the first fold line from the box back wall. In these embodiments, the height of the first fold line up the box back wall is preferably substantially the same as the height of a lid back wall so that when the container is placed on a flat surface with the lid and the movable container back wall in their open positions, the box bottom wall and a lid top wall rest on the flat surface and the movable container back wall extends substantially horizontally between the lid and the box back wall. In this case, the horizontal movable container back wall can provide a platform on which the user may place items while removing or consuming consumer goods from the container. For example, in embodiments in which the container houses one or more smoking articles, the horizontal platform may be used to receive an ashtray while the user consumes one of the smoking articles. In those embodiments comprising both first and second compartments, the second compartment may function to receive waste, such as ash or cigarette butts, when the movable container back wall is in the horizontal position.

The invention will now be further described, by way of example only, with reference to the accompanying drawings in which.

Figure 1:
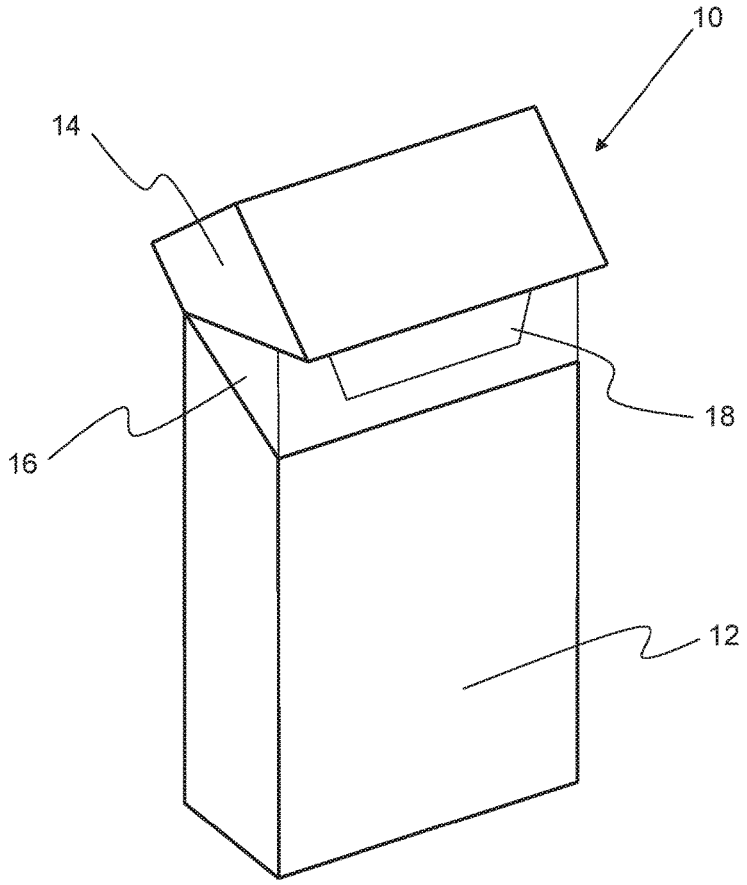
FIG. 1 PRIOR ART
FIG. 1 shows a perspective view of a prior art hinge-lid container.

FIG. 1 shows a prior art hinge-lid container 10 for housing a plurality of aerosol-generating articles, such as a bundle of cigarettes. The container 10 comprises a box 12 and a lid 14 depending along a hinge line from a back wall of the box 12. The box 12 defines a single compartment in which the aerosol-generating articles are housed.

An inner frame 16 is attached to an inner surface of the box 12 and extends above a top edge of the box 12. The inner frame 16 defines an aperture 18 through which the aerosol-generating articles can be removed when the lid 14 is in an open position. The lid 14 is shown between the open position and a closed position in FIG. 1. Typically, the box 12 and the lid 14 are formed from a first laminar blank, and the inner frame 16 is formed from a second laminar blank.

Figure 2:
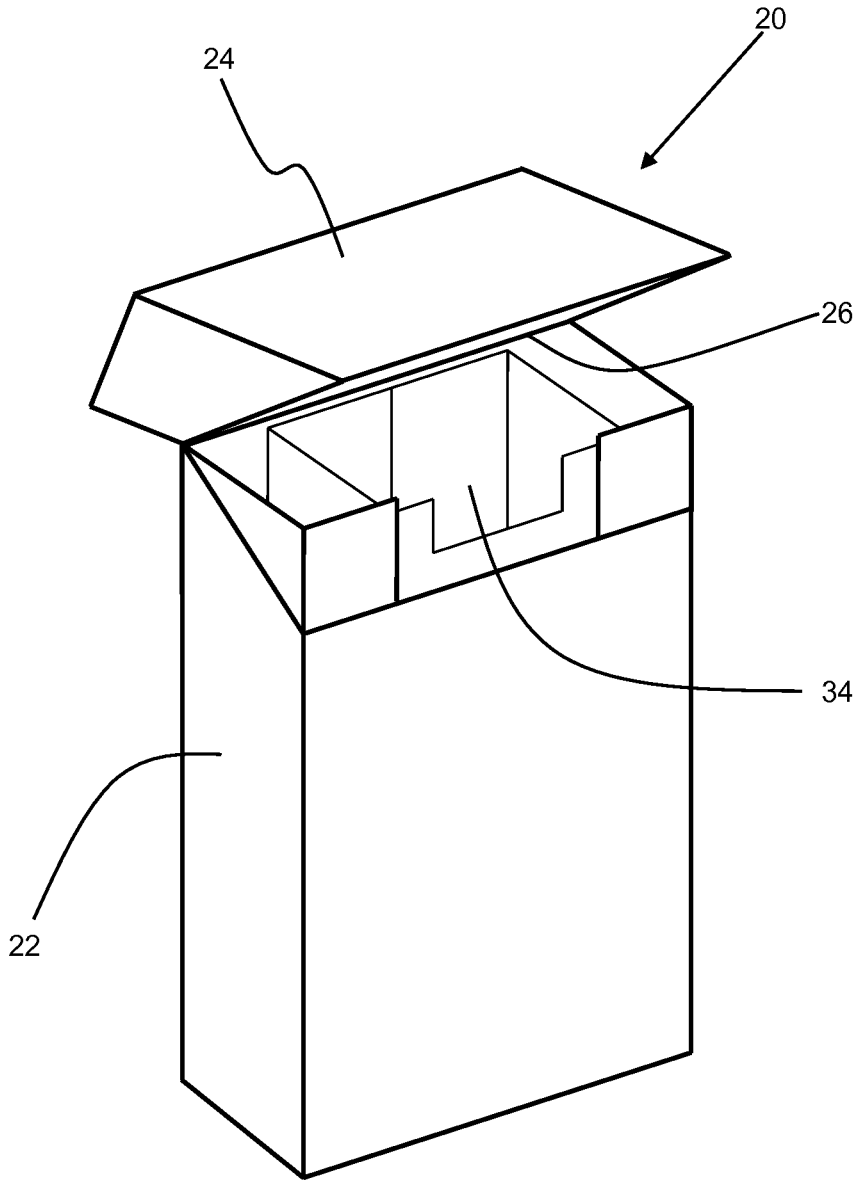
FIG. 2 shows a front perspective view of a hinge-lid container in accordance with an embodiment of the present invention.
Figure 3:
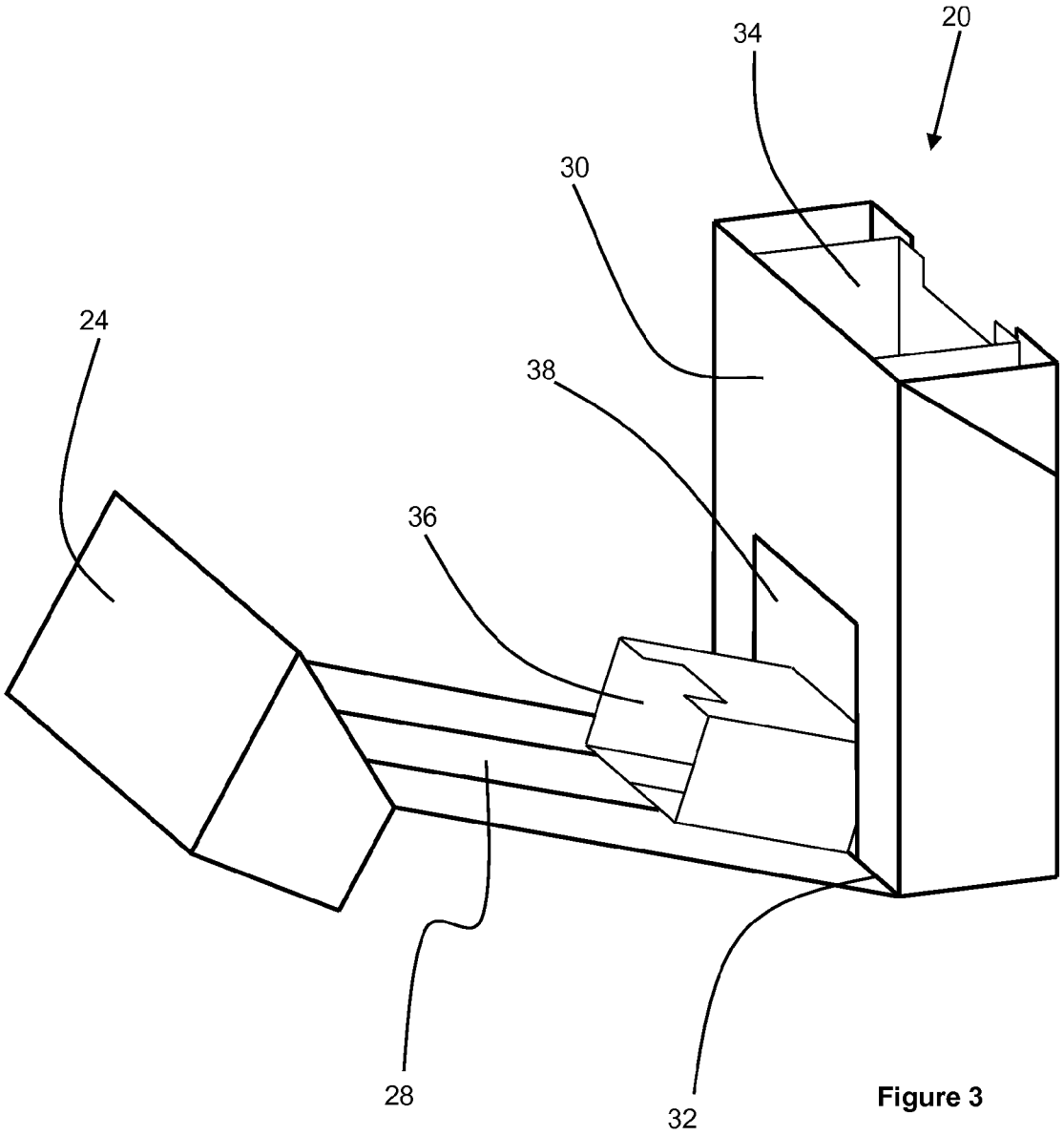
FIG. 3 shows a rear perspective view of the hinge-lid container of FIG. 2.

FIGS. 2 and 3 show a hinge-lid container 20 in accordance with an embodiment of the present invention. The container 20 comprises a box 22 and a lid 24 depending along a hinge line 26 from a movable back wall 28 of the container 20. The movable container back wall 28 is shown more clearly in FIG. 3, together with a box back wall 30. The movable container back wall 28 depends, at its bottom edge, along a fold line 32 from a bottom wall of the box 22, and the lid 24 depends along the hinge line 26 from a top edge of the movable container back wall 28. The movable container back wall 28 is movable about the fold line 32 between a closed position in which it lies against the box back wall 30 and an open position shown in FIG. 3.

A first compartment 34 for receiving one or more consumer goods is provided on the box back wall 30, the first compartment 34 located in an upper portion of the box 22. A second compartment 36 for receiving one or more consumer goods is provided on the movable container back wall 28 and extends through an aperture 38 in the box back wall 30 into a lower portion of the box 22 when the movable container back wall 28 is in the closed position. When the movable container back wall 28 is moved into the open position shown in FIG. 3, the second compartment 36 is moved through the aperture 38 and outside of the lower portion of the box 22.

Advantageously, the hinge-lid container 20 in accordance with the present invention has the same external dimensions and appearance as the conventional hinge-lid container 10 shown in FIG. 1, when the lids are in the closed positions.

However, the first and second compartments 34 and 36 of the hinge-lid container 20 in accordance with the present invention can accommodate consumer goods that are smaller than the consumer goods housed within the conventional container 10. For example, the first and second compartments 34 and 36 can house aerosol-generating articles for use with an electrically operated smoking system, which may be significantly shorter than conventional filter cigarettes that may be housed within the conventional hinge-lid container 10.

To access the first compartment 34, the user need only open the lid 24 of the hinge-lid container 20. To access the second compartment 36, the user must first open the lid 24 and then move the movable container back wall 28 into the open position.

Figure 4:
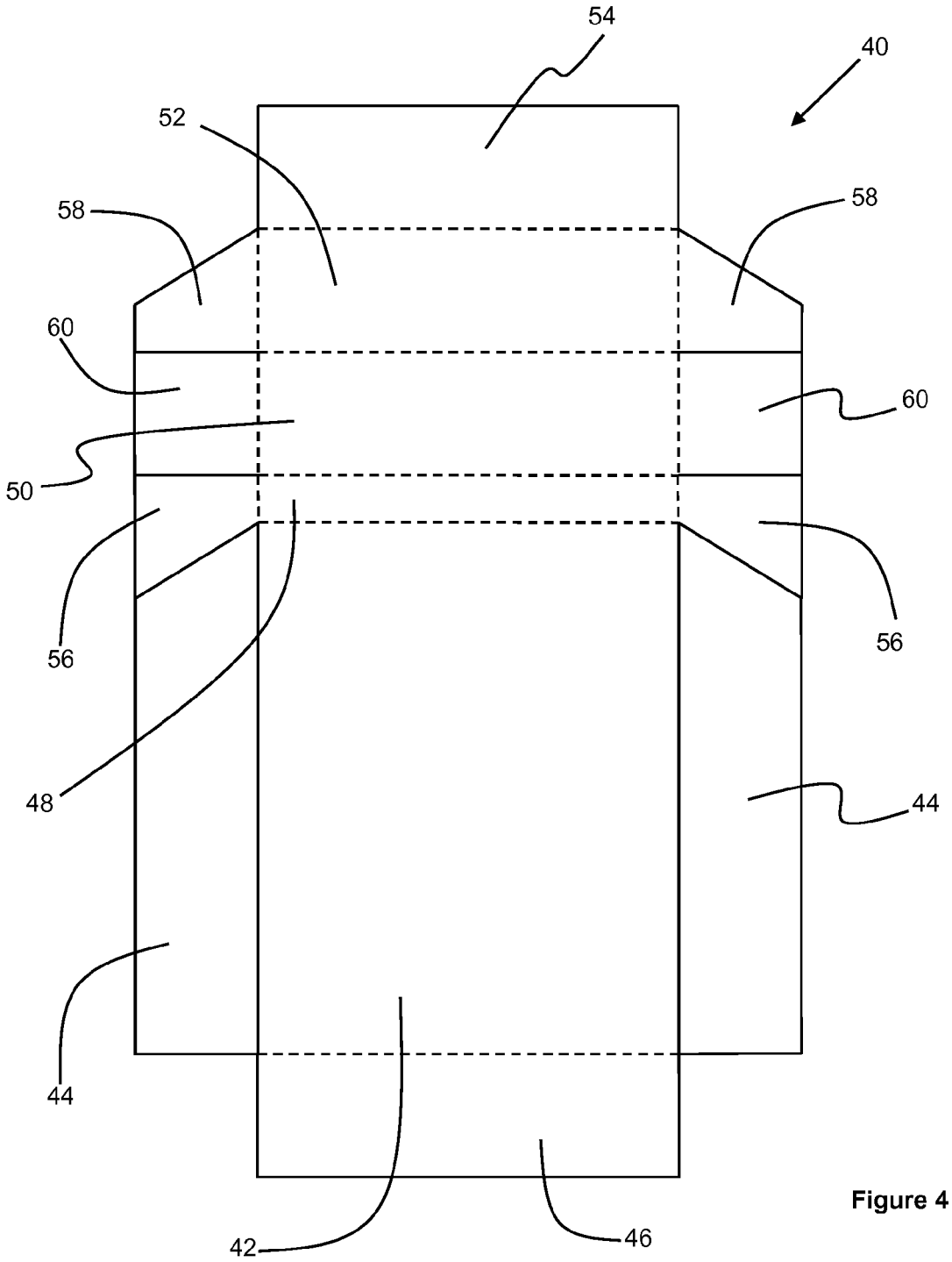
FIG. 4 shows an outer laminar blank for forming part of the hinge-lid container of FIG. 2.

FIG. 4 shows an outer laminar blank 40 for forming the lid 24, the movable container back wall 28 and a first box bottom panel of the hinge-lid container 20 of FIGS. 2 and 3. Dashed lines indicate folding lines and solid lines indicate cut lines and edges of the blank.

The outer laminar blank 40 comprises an outer movable back panel 42, movable portion flaps 44, and a first box bottom panel 46 depending along a fold line from a bottom edge of the outer movable back panel 42. A lid back panel 48 depends along a fold line from a top edge of the outer movable back panel 42, a lid top panel 50 depends along a fold line from a top edge of the lid back panel 48, a lid front panel 52 depends along a fold line from a top edge of the lid top panel 50, and a reinforcing under panel 54 depends along a fold line from a top edge of the lid front panel 52. A first set of lid side flaps 56 depend along fold lines from the lid back panel 48 and a second set of lid side flaps 58 depend along fold lines from the lid front panel 52. Lid top flaps 60 depend along fold lines from the lid top panel 50.

Figure 5:
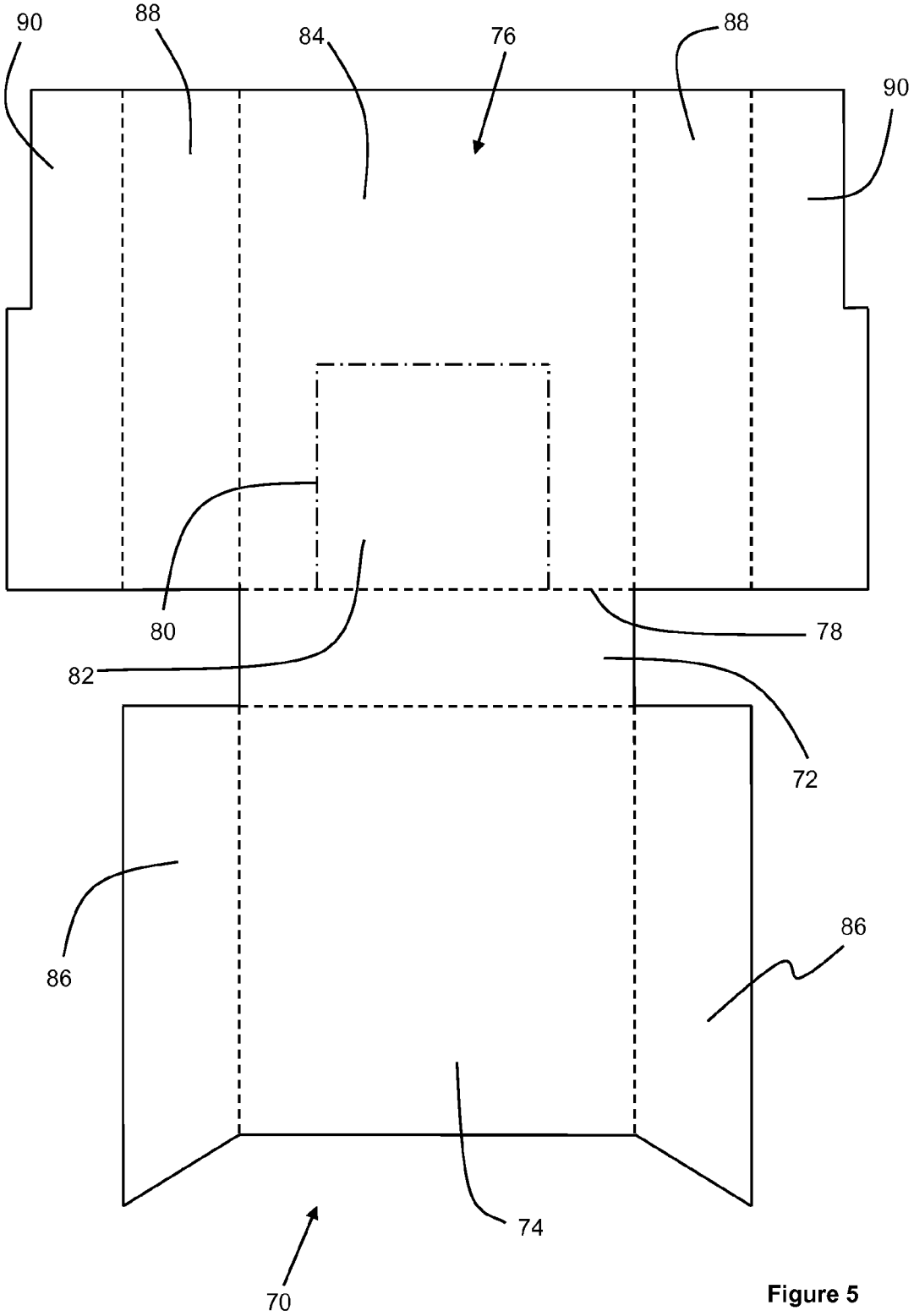
FIG. 5 shows an inner laminar blank for forming part of the hinge-lid container of FIG. 2.

FIG. 5 shows an inner laminar blank 70 for forming the box 22 of the hinge-lid container 20 of FIGS. 2 and 3. Dashed lines indicate folding lines and solid lines indicate cut lines and edges of the blank.

The inner laminar blank 70 comprises a second box bottom panel 72 and a box front panel 74 depending along a fold line from a bottom edge of the second box bottom panel 72. A back panel 76 depends along a fold line 78 from a top edge of the second box bottom panel 72, the back panel 76 comprising a perforation line 80. The portion of the back panel 76 delineated by the perforation line 80 and the fold line 78 along the top edge of the second box bottom panel 72 forms an inner movable back panel 82. The remainder of the back panel 76 forms a box back wall 84.

Box side flaps 86 depend along fold lines from side edges of the box front panel 74 and inner frame side panels 88 depend along fold lines from side edges of the box back wall 84. Inner frame front flaps 90 extend along fold lines from side edges of the inner frame side panels 88.

Figure 6:
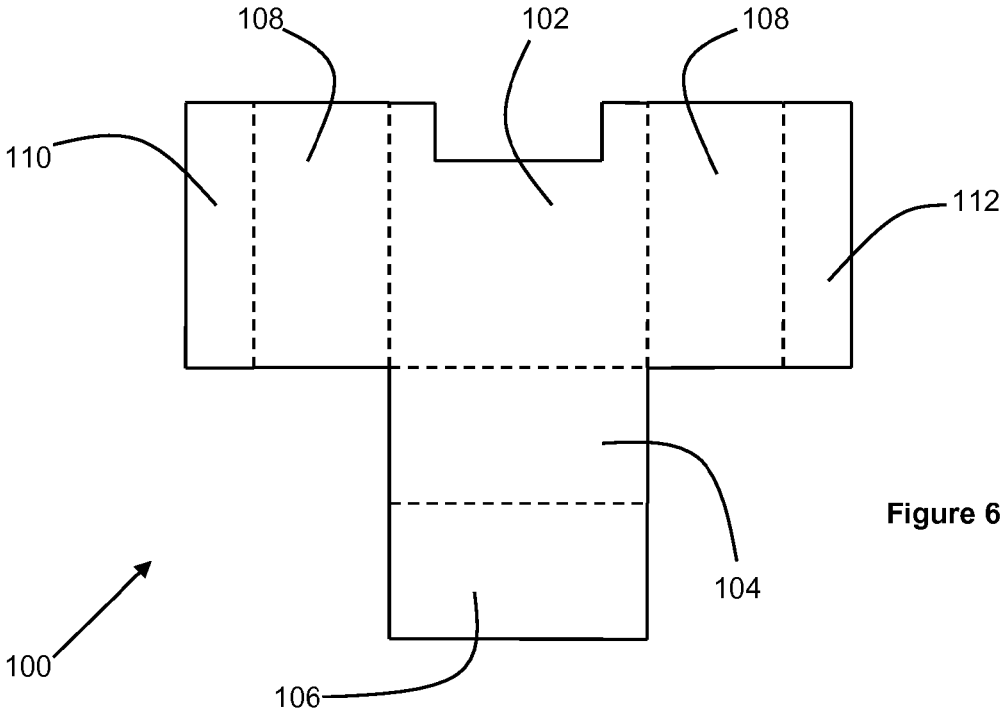
FIG. 6 shows a blank for forming a compartment within the hinge-lid container of FIG. 2.

FIG. 6 shows a laminar blank 100 for forming a compartment of the hinge-lid container 20 of FIGS. 2 and 3. Dashed lines indicate folding lines and solid lines indicate cut lines and edges of the blank.

The laminar blank 100 comprises a compartment front panel 102, a compartment bottom panel 104 depending along a fold line from a bottom edge of the compartment front panel 102, and a first compartment back flap 106 depending along a fold line from the compartment bottom panel 104. Compartment side panels 108 depend along fold lines from side edges of the compartment front panel 102, and second and third compartment back flaps 110 and 112 depend along fold lines from side edges of the compartment side panels 108.

To form a compartment for the hinge-lid housing 20, the laminar blank 100 is folded so that the compartment bottom panel 104 forms a bottom wall of the compartment and the compartment side panels 108 form side walls of the compartment. The laminar blank 100 is also folded so that the second and third compartment back flaps 110 and 112 abut or partially overlap each other as well as both overlapping the first compartment back flap 106. The first, second and third compartment back flaps 106, 110 and 112 together form a back wall of the compartment. The second and third compartment back flaps 110 and 112 are adhered to the first compartment back flap 106 to retain the laminar blank 100 in the folded state. A folded laminar blank 100 forming a compartment is shown in FIG. 7.

Figure 7:
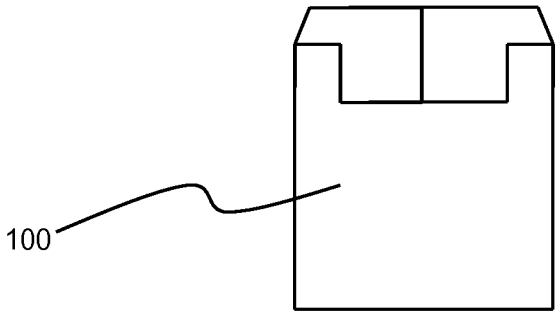
FIGS. 7 to 12 shows the step of assembling the blanks of FIGS. 4, 5 and 6 to form the container of FIG. 2.

To form a hinge-lid container 20 as shown in FIGS. 2 and 3, two compartments as shown in FIG. 7 are provided, at least one of the compartments housing one or more consumer goods. The consumer goods may be inserted into the compartment after the laminar blank 100 has been folded to form the compartment, or the laminar blank 100 may be folded around the one or more consumer goods when forming the compartment.

Figure 8:
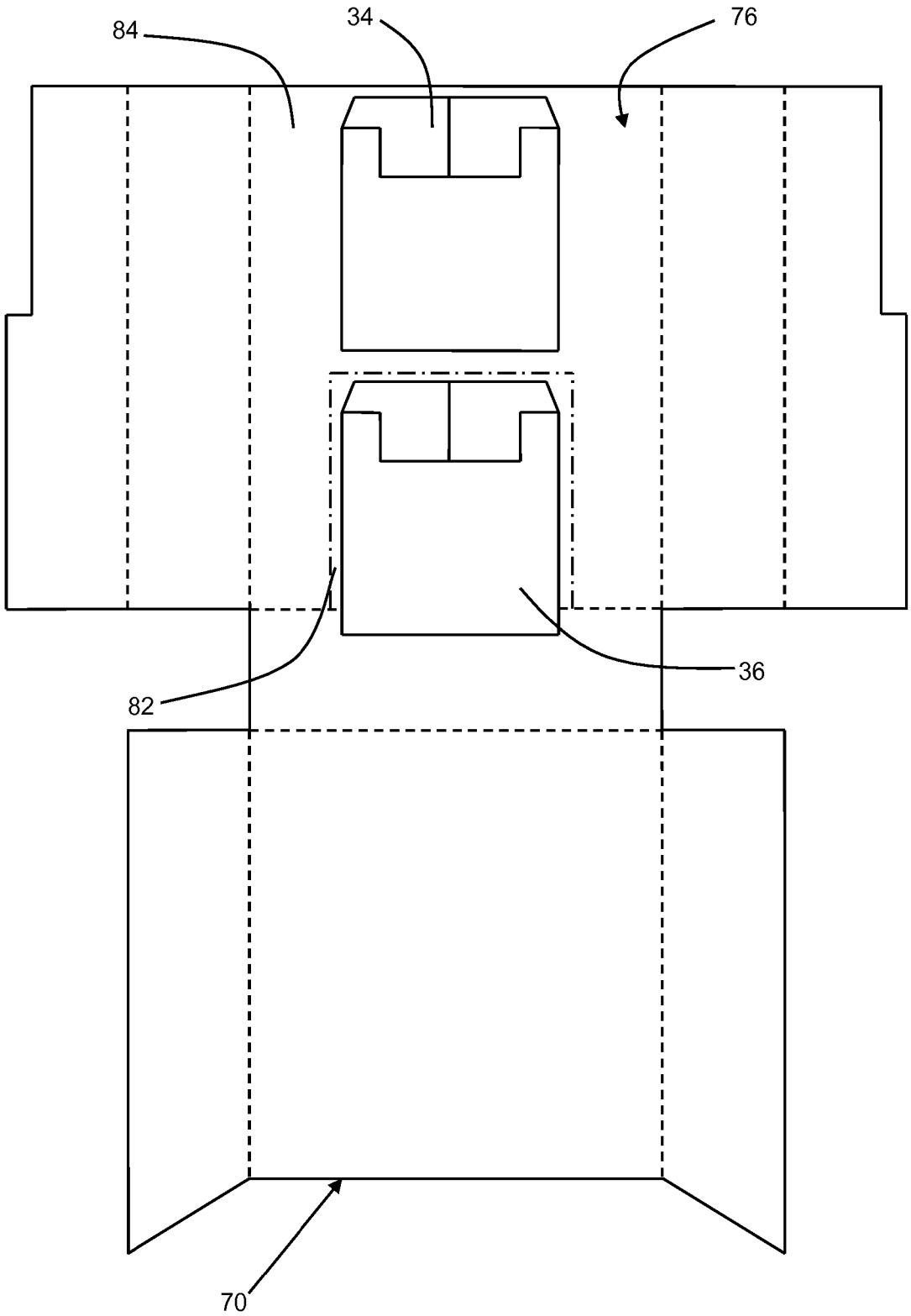

As shown in FIG. 8, the two compartments are secured to the back panel 76 on the inner laminar blank 70. One of the compartments is secured to the box back wall 84 to form the first compartment 34 and the other compartment is secured to the inner movable back panel 82 to form the second compartment 36. The compartments may be secured to the inner laminar blank 70 using a suitable adhesive.

Figure 9:
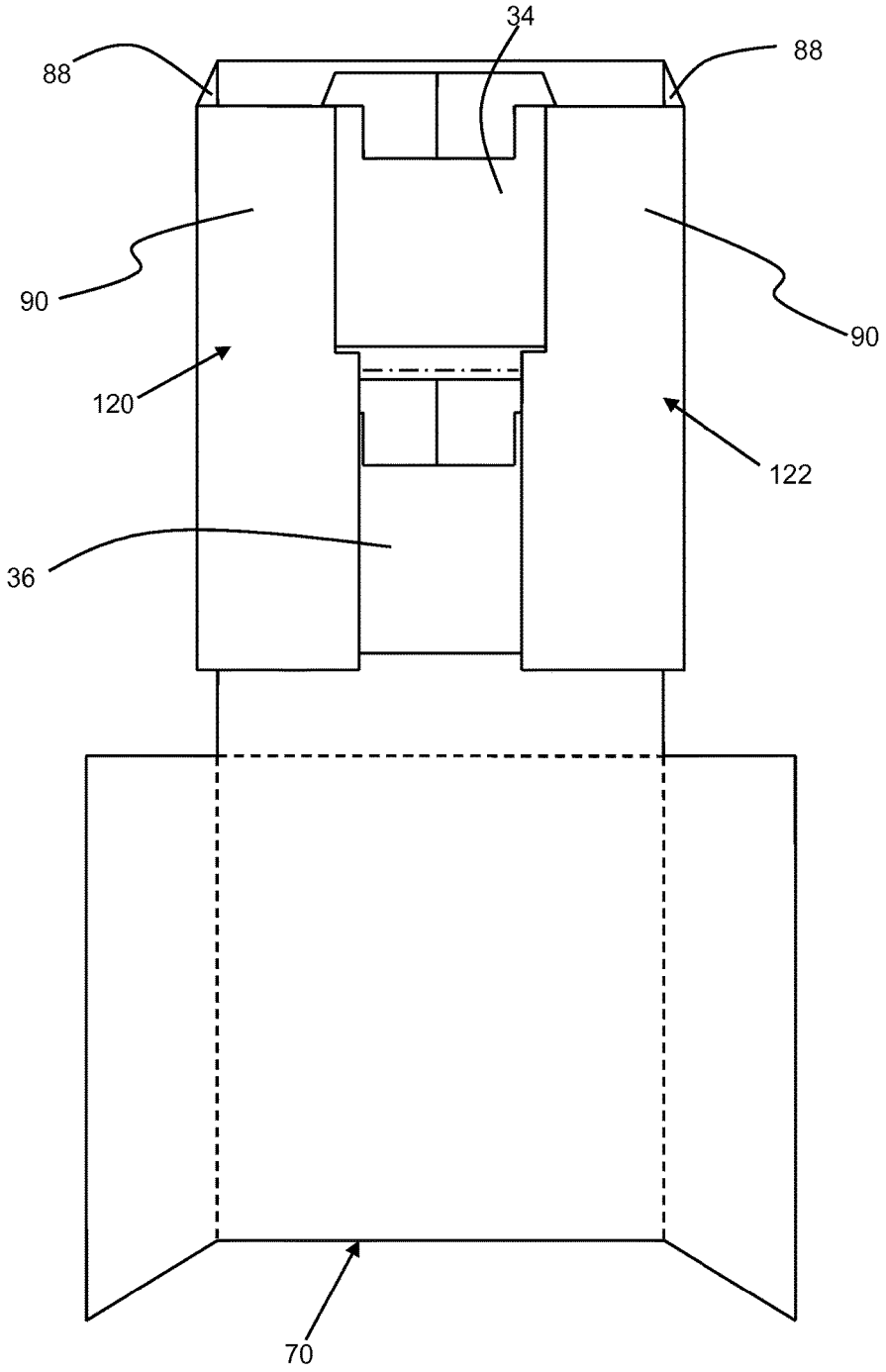
Figure 10:
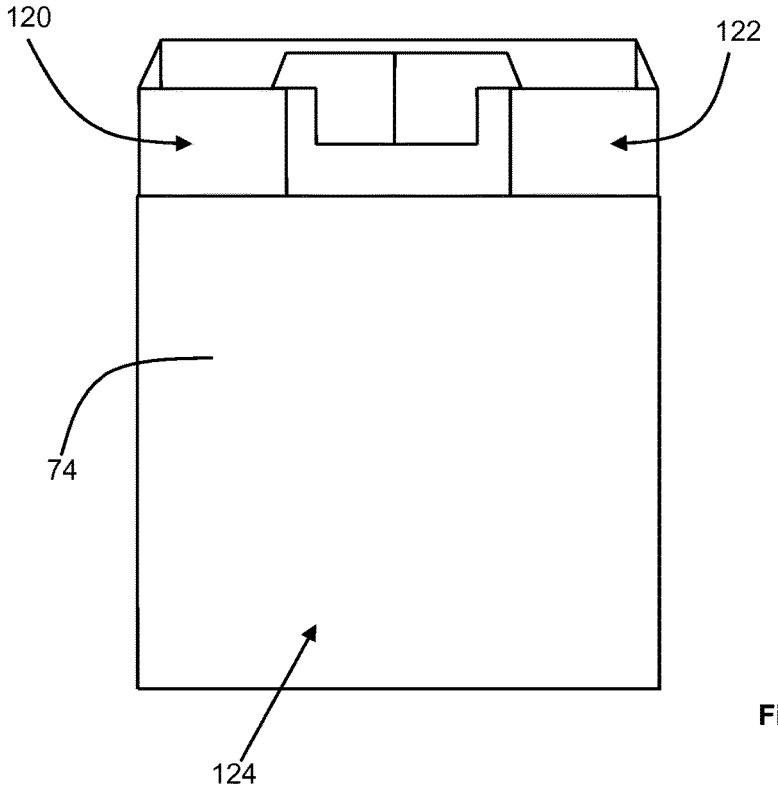

The inner frame side panels 88 and the inner frame front flaps 90 of the inner laminar blank 70 are then folded around the first and second compartments 34 and 36 to form first and second inner frame portions 120 and 122, as shown in FIG. 9.

Next, the second box bottom panel 72 is folded underneath the second compartment 36, and the box front panel 74 is folded over the front of the first and second inner frame portions 120 and 122 so that they together form a box front wall 124. The box side flaps 86 are folded around the sides of the first and second inner frame portions 120 and 122 so that they together form box side walls.

To prepare the outer laminar blank 40 for receiving the folded inner laminar blank 70, the movable portion flaps 44 are folded over and preferably adhered to an inner surface of the outer movable back panel 42 to reinforce the outer movable back panel 42.

To further prepare the outer laminar blank 40 for receiving the folded inner laminar blank 70, the reinforcing under panel 54 is folded over and preferably adhered to an inner surface of the lid front panel 52, and the lid top flaps 60 are folded over and preferably adhered to an inner surface of the lid top panel 50.

Figure 11:
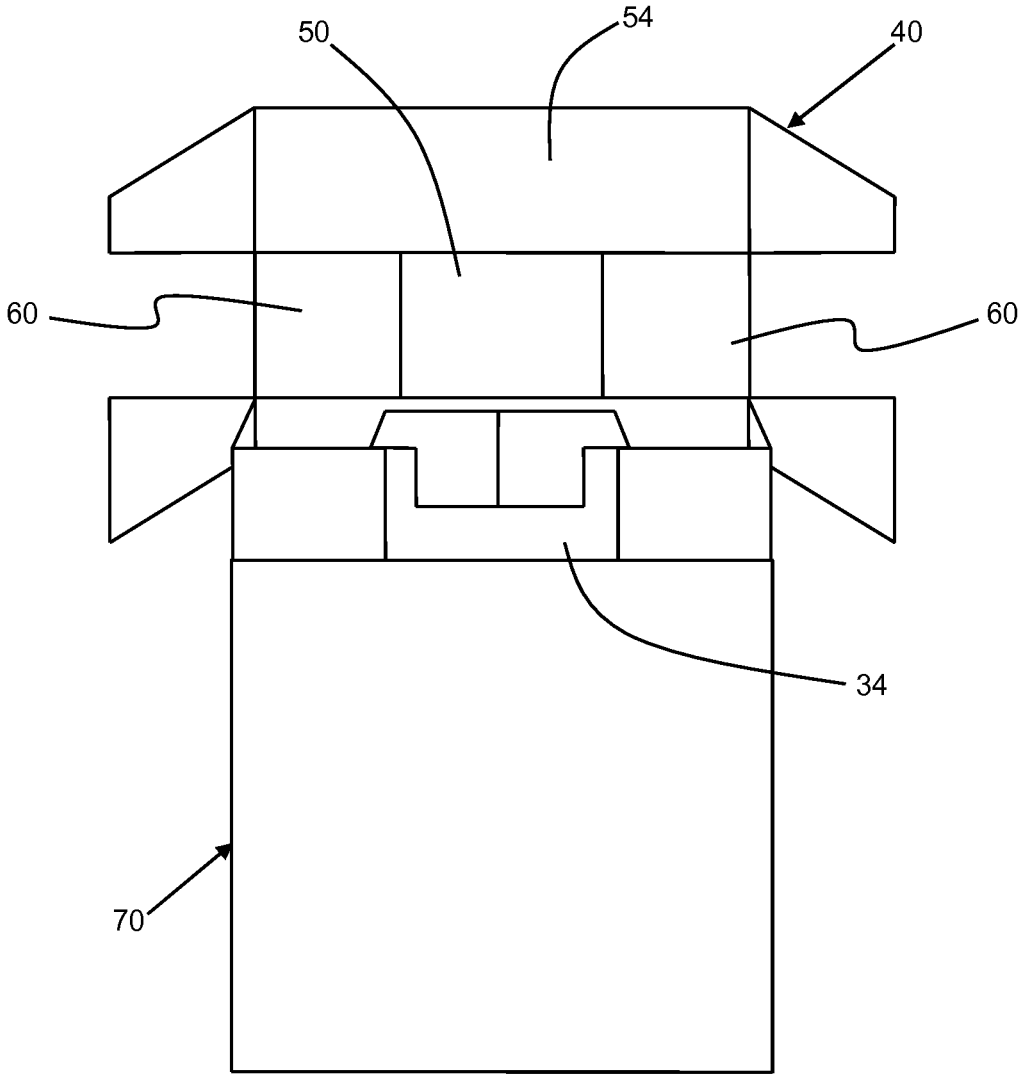

As shown in FIG. 11, the folded inner laminar blank 70 containing the first and second compartments 34 and 36 is secured to the prepared outer laminar blank 40. Specifically, the outer surface of the inner movable back panel 82 is adhered to the inner surface of the outer movable back panel 42 and the folded movable portion flaps 44, and the outer surface of the second box bottom panel 72 is adhered to the inner surface of the first box bottom panel 46. The outer movable back panel 42, the folded movable portion flaps 44 and the inner movable back panel 82 together form the movable container back wall 28. The first and second box bottom panels 46 and 72 together form the bottom wall of the box.

Figure 12:
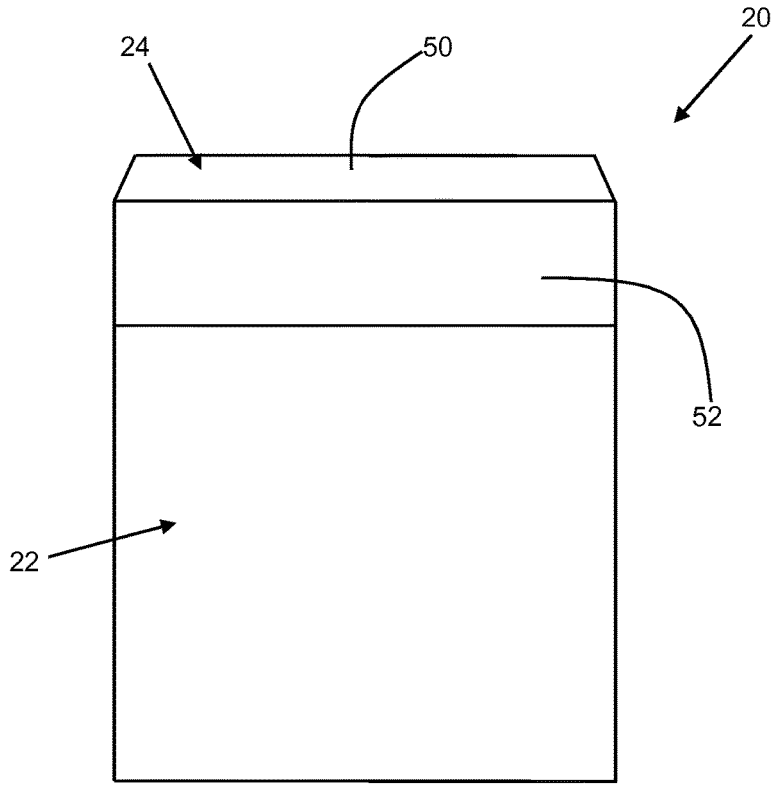

Finally, the lid top panel 50, the lid front panel 52, and the first and second sets of lid side flaps 56 and 58 are folded to form the lid 24, as shown in FIG. 12. To maintain the lid panels and flaps in their folded positions, each of the second lid side flaps 58 overlaps and is adhered to the corresponding first lid side flap 56 to form a lid side wall.

The invention claimed is:

1. A container for consumer goods, comprising:

a box comprising a bottom wall, two side walls, a back box wall, and a front wall;

a movable container back wall depending along a first fold line from the box, wherein the movable container back wall is movable about the first fold line between an open position and a closed position, and at least partially overlies the back box wall when the movable container back wall is in the closed position;

a lid depending along a hinge line from the movable container back wall, the lid being movable between an open lid position and a closed lid position;

a first compartment configured to receive consumer goods and located in the box, wherein the first compartment is accessible when the lid is in the open lid position; and a second compartment configured to receive the consumer goods and located in the box, wherein the second compartment is accessible when both the lid and the movable container back wall are in their respective open positions.

2. The container according to claim 1, further comprising an aperture in the back box wall, wherein the movable container back wall at least partially covers the aperture when the movable container back wall is in the closed position, and wherein the aperture is configured to permit access to the second compartment when the movable container back wall is moved from the closed position to the open position.

3. The container according to claim 2, wherein the second compartment is connected to the movable container back wall, and wherein the second compartment moves through the aperture in the back box wall when the movable container back wall moves between the open and closed positions.

4. The container according to claim 1, further comprising at least one frangible portion connecting a part of the movable container back wall to the box, wherein the at least one frangible portion retains the movable container back wall in the closed position, and wherein the at least one frangible portion is broken upon first moving the movable container back wall into the open position.

5. The container according to claim 1, further comprising an aerosol-generating article within at least one of the first and second compartments.

6. A method of forming a container for consumer goods, the method comprising:

folding a first laminar blank to form a first compartment configured to receive consumer goods;

folding a second laminar blank to form a second compartment configured to receive the consumer goods;

securing the first and second compartments to a third laminar blank;

folding the third laminar blank around the first and second compartments to form a box comprising a bottom wall, two side walls, and a front wall;

securing the folded third laminar blank to a fourth laminar blank; and folding the fourth laminar blank to form a movable container back wall and a lid, wherein the movable container back wall depends along a first fold line from the box and is movable about the first fold line between an open position and a closed position, wherein the lid depends along a hinge line from the movable container back wall and is movable between an open lid position and a closed lid position, wherein the first compartment is accessible when the lid is in the open lid position, and wherein the second compartment is accessible when both the lid and the movable container back wall are in their respective open positions.

7. The method according to claim 6, wherein the step of folding the third laminar blank to form the box further comprises folding the third laminar blank to form a back box wall, and wherein the movable container back wall overlies the back box wall when the movable container back wall is in the closed position.

8. The method according to claim 6, wherein the third laminar blank comprises a first side, a second side, and a line of weakening, wherein the step of securing the first and second compartments to the third laminar blank comprises securing a back wall of each of the first and second compartments to the first side of the third laminar blank, wherein the step of folding the third laminar blank further comprises folding the third laminar blank around the first and second compartments to form a back box wall and a first movable back panel, the first movable back panel being delineated by the line of weakening and the first fold line, wherein the first compartment is secured to the back box wall and wherein the second compartment is secured to the first movable back panel, wherein the step of folding the fourth laminar blank further comprises folding the fourth laminar blank to form a second movable back panel and the lid depending from the second movable back panel, and wherein the step of securing the folded third laminar blank to the fourth laminar blank comprises securing the second movable back panel of the fourth laminar blank to the second side of the first movable back panel of the third laminar blank so that the first and second movable back panels together form the movable container back wall.

9. The method according to claim 8, wherein the line of weakening comprises at least one frangible portion connecting the first movable back panel to the back box wall, wherein the at least one frangible portion retains the movable container back wall in the closed position, and wherein the at least one frangible portion is broken upon first moving the movable container back wall into the open position.

10. The method according to claim 8, wherein an edge of the first movable back panel defines an aperture in the back box wall, wherein the movable container back wall covers the aperture when the movable container back wall is in the closed position, and wherein the aperture is configured to permit access to the second compartment when the movable container back wall is moved from the closed position to the open position.

11. The method according to claim 10, wherein the second compartment moves through the aperture in the back box wall when the movable container back wall moves between the open and closed positions.

12. The method according to claim 6, wherein the steps of folding the first and second laminar blanks further comprise folding at least one of the first and second laminar blanks around an aerosol-generating article.

* * * * *